US011473349B2

(12) United States Patent
Wahba

(10) Patent No.: US 11,473,349 B2
(45) Date of Patent: Oct. 18, 2022

(54) DOOR LOCK ASSEMBLY AND METHODS OF USE THEREOF

(71) Applicant: Hadi Wahba, Alpharetta, GA (US)

(72) Inventor: Hadi Wahba, Alpharetta, GA (US)

( * ) Notice: Subject to any disclaimer, the term of this patent is extended or adjusted under 35 U.S.C. 154(b) by 853 days.

(21) Appl. No.: 16/370,392

(22) Filed: Mar. 29, 2019

(65) Prior Publication Data

US 2019/0301214 A1 Oct. 3, 2019

Related U.S. Application Data

(60) Provisional application No. 62/650,341, filed on Mar. 30, 2018.

(51) Int. Cl.

| | |
|---|---|
| ***E05C 1/00*** | (2006.01) |
| ***E05B 17/20*** | (2006.01) |
| ***E05B 45/12*** | (2006.01) |
| ***G08B 13/08*** | (2006.01) |

(52) U.S. Cl.

CPC ..... *E05C 1/004* (2013.01); *E05B 17/2003* (2013.01); *E05B 45/12* (2013.01); *G08B 13/08* (2013.01); *E05B 2017/2096* (2013.01)

(58) Field of Classification Search

CPC ..... E05B 17/2003; E05B 1/004; E05B 45/12; E05B 2017/2096; G08B 13/08; E05C 19/18

USPC ..... 70/91; 292/146, 148, 288, 289, 292, 292/341.12, 341.13, 251.5, DIG. 30; 16/380, 371, 385, DIG. 43

See application file for complete search history.

(56) References Cited

U.S. PATENT DOCUMENTS 1,517,447 A * 12/1924 Merz ..... E05D 15/00 292/145
2,824,300 A * 2/1958 Rand ..... E05B 45/086 340/521
3,206,793 A * 9/1965 Silverberg ..... E05C 19/003 292/288
3,352,587 A * 11/1967 Harvey ..... E05C 19/182 292/289
3,726,555 A * 4/1973 Lawson ..... E05C 19/182 292/288
3,914,965 A 10/1975 Paxton
3,920,110 A * 11/1975 Douglas ..... E05B 65/001 292/341.13

(Continued)

FOREIGN PATENT DOCUMENTS

EP 2248969 A1 * 11/2010 ..... E05B 17/2003

*Primary Examiner* — Suzanne L Barrett

(74) *Attorney, Agent, or Firm* — Mathew L. Grell; Grell & Watson Patent Attorneys LLC

(57) ABSTRACT

A door lock assembly for a door hinged to a door frame, having primarily a two-part lock assembly, including a linear pin or bolt having a first pin end and a second pin end, the second pin end formed with a handle attached and a magnet positioned therearound the second pin end and proximate a junction between the handle and the second pin end and a mounting plate having a first plate end and a second plate end, the plate ends having a one or more mounting holes, the mounting plate having a base or humped body positioned between first plate end and a second plate end, the humped body having a locking aperture positioned crosswise there through the humped body to receive first pin end.

25 Claims, 4 Drawing Sheets

(56) References Cited

U.S. PATENT DOCUMENTS 4,161,333 A * 7/1979 Guttman ..... E05C 19/18 292/288
4,235,464 A 11/1980 Cantley
4,400,027 A * 8/1983 Nahon ..... E05B 65/0864 292/288
D272,041 S * 1/1984 Harris ..... D8/330
4,439,758 A * 3/1984 Cantley ..... E05C 19/184 292/288
4,627,651 A 12/1986 Grimbly
4,716,402 A 12/1987 Francis
4,825,509 A * 5/1989 Mitchell ..... E05D 5/06 49/501
4,844,519 A * 7/1989 Dagon ..... E05C 19/184 292/57
5,280,976 A 1/1994 Melyon
5,401,068 A * 3/1995 Barnard ..... E05C 19/18 292/289
5,454,143 A * 10/1995 Wigley, Sr. ..... E05B 65/0894 16/82
5,685,580 A 11/1997 West et al.
5,760,678 A 6/1998 Pavlacka et al.
5,772,265 A * 6/1998 Gilbert ..... E05C 3/04 292/210
7,360,805 B1 * 4/2008 Brown ..... E05B 65/0888 292/259 R
7,408,477 B2 8/2008 Finkle et al.
7,651,140 B2 * 1/2010 Leggio ..... E05B 63/0004 292/342
7,770,420 B2 * 8/2010 Carr ..... E05C 19/003 292/259 R
8,459,704 B2 6/2013 Daniels et al.
8,495,897 B1 * 7/2013 Koc ..... E05C 19/184 292/205
9,024,758 B2 5/2015 Bushee
D733,520 S * 7/2015 Barna ..... D8/343
9,546,507 B2 1/2017 Letson
9,799,181 B2 * 10/2017 Cushwa, Jr. ..... G08B 13/08
9,999,999 B2 6/2018 Bazzo
10,689,890 B2 * 6/2020 Taylor ..... E05B 63/0004
2005/0127689 A1 6/2005 Tang
2006/0279093 A1 * 12/2006 Tang ..... E05C 17/166 292/288
2007/0096478 A1 * 5/2007 White ..... E05C 19/184 292/288
2016/0083990 A1 * 3/2016 Ricks ..... E05D 15/00 16/223
2020/0063475 A1 * 2/2020 Seelbinder ..... G08B 5/36

* cited by examiner

DOOR LOCK ASSEMBLY AND METHODS OF USE THEREOF

CROSS-REFERENCE TO RELATED APPLICATIONS

To the full extent permitted by law, the present United States Non-provisional Patent Application hereby claims priority to and the full benefit of, U.S. Provisional Application No. 62/650,341, filed on Mar. 30, 2018, entitled "Quick Class Room Door Lock and Methods of Use", which is incorporated by reference herein in its entirety.

FIELD OF THE DISCLOSURE

The present disclosure is directed to a closure fastener and methods of use thereof. More specifically, the present disclosure is directed to a two part lock accessory adapted to be manually installed on the inside of a frame and a sliding holding member preventing unauthorized opening of the door.

BACKGROUND

Various approaches have been utilized to lock a door using a safety lock for securing the door to a frame to prevent opening from the outside. For example primary lock assemblies utilize a bolt that extends horizontally between the door and frame across the swinging edge of the door. One such previous primary approach includes a handle driven spring latch lock which uses a spring to hold the latch in a slot bored into the front face of a door jamb to keep the door closed. One disadvantage or drawback to this approach is that, retraction of the latch may occur by wedging a tool into the gap and prying the spring held latch enabling retraction of the bolt itself. Another previous primary approach includes a deadbolt, which uses a key or inside lever to rotate or move the bolt in a slot bored into the front face of a door jamb to keep the door closed. One disadvantage or drawback to this approach is that, these devices are difficult to install in that they require internal drilling of the door as well as of the frame for mounting requiring corresponding aligned holes being drilled in the frame and the door edge. Another disadvantage is that the door can easily be kicked in if the frame is made of wood because the deadbolt acts as a device that splits the frame.

Additionally, secondary lock assemblies include a door chain or security chain lock or hinged lever, which uses a small chain with a small knob attached to one end that can be moved into or out of a receiving channel of a door plate or a hasp, which is a slotted hinged metal plate that forms part of a fastening for a door and is fitted over a metal loop or swivel eye on the frame and turned in a locked or unlocked position. The hasp may be secured by a pin or padlock to keep the door closed or limited opening. One disadvantage or drawback to this approach is that, the small chain or lever attached to the door can be cut with a cutting tool since it is visible during limited opening of the door.

Another previous secondary lock assembly includes a plate mounted to the front face of the frame or door jamb between the door and the frame facing the closed door and extending horizontally into the interior. The interior section includes a hole to receive a threaded bolt or clasping pin crosswise to the plate and when inserted the bolt or pin blocks the door from swinging open by contact with the swinging door up against the bolt and holds the door closed. One disadvantage or drawback to this approach is that, lock assembly holding power against a large force causes the secondary lock assembly to twist or pivot possibly freeing the door from the bolt and not keeping the door closed and locked. Another disadvantage or drawback to this approach is that, a threaded bolt or clasping pin takes additional time to position and lock the secondary lock assembly. Yet another disadvantage or drawback to this approach is due to the limited material thickness of the door and door frame, such devices can be forced open if sufficient force is applied to the door.

Therefore, it is readily apparent that there is a need for a door lock assembly that can be easily installed by the occupant when extra door lock protection is required, which is extremely difficult to forcibly break away from the door and door frame and maintain holding power against a large force, which will not present an unsightly appearance when not in use, which is simple enough to operate by a school age child, which is of a relatively inexpensive construction, and which can be installed with a minimum of labor and expense. The instant disclosure is designed to address at least certain aspects of the problems or needs discussed above by enabling a two part lock accessory adapted to be manually installed on the inside of a frame or wall and a sliding holding member which prevents unauthorized opening of the door.

SUMMARY

Briefly described, in an example embodiment, the present disclosure may overcome the above-mentioned disadvantages and may meet the recognized need for a door lock assembly for a door hinged to a door frame, having primarily a two-part lock assembly, including a linear pin or bolt having a first pin end and a second pin end, the second pin end formed with a handle attached and a magnet positioned therearound the second pin end and proximate a junction between the handle and the second pin end and a mounting plate having a first plate end and a second plate end, the plate ends having one or more mounting holes, the mounting plate having a base or humped body positioned between first plate end and a second plate end, the humped body having a locking aperture positioned crosswise there through the humped body to receive first pin end and, thus, functions to be easily installed by the occupant when extra door lock protection is required, which is extremely difficult to forcibly break away from the door and door frame and maintains holding power against a large force, which will not present an unsightly appearance when not in use, which is simple enough to operate by a school age child, which is of a relatively inexpensive construction, and which can be installed with a minimum of labor and expense.

Accordingly, in one aspect, the present disclosure may include a pin keeper having a cover and a backplate with a plurality of mounting apertures and two or more pin supports mounted on the backplate, the two or more pin supports having a support aperture there through to receive the first pin end therein to store the pin when not in use. One of the two or more pin supports may be formed of an iron or metal material wherein the magnet's attraction holds the handled pin therein the two or more pin supports.

Accordingly, in another aspect, the present disclosure may include an alarm system having a power supply, an alarm, and a contact switch, in a normally closed state positioned in electrical communication with each other, to receive the first pin end therein the pin keeper to deactivate or open the switch but on removal of the pin the switch closes and activates the alarm system.

Accordingly, in another aspect, the present disclosure may include a set of slotted u-shaped door hinge supports fabricated to fit around a door hinge to reinforce the hinge side of the door.

Accordingly, in another aspect, the present disclosure may include mounting hardware to secure the mounting plate to the door or door frame, to secure the pin keeper to an adjacent wall, and to mount the door hinge supports.

In an exemplary embodiment of the door lock assembly to secure a door having hinges between the door and a door frame positioned in a wall, the door lock assembly including a pin having a first pin end and a second pin end, the second pin end formed with a handle attached thereto and a magnet positioned proximate a junction between the handle and the second pin end, and a mounting plate having a first base plate end and a second base plate end, the first base plate end and the second base plate end having one or more base attachment apertures to affix to the door frame, the mounting plate having a midsection positioned between the first base plate end and the second base plate end, the midsection having a locking aperture positioned crosswise therethrough to receive first pin end, the first pin end pass therethrough the locking aperture until the magnet contacts the mounting plate, and the first pin end extends across to the door.

In another exemplary embodiment of a method of securing a door having hinges between the door and a door frame positioned in a wall, the method including the steps of providing a door lock assembly with a pin having a first pin end and a second pin end, the second pin end formed with a handle attached thereto and a magnet positioned proximate a junction between the handle and the second pin end, a mounting plate having a first base plate end and a second base plate end, the first base plate end and the second base plate end having one or more base attachment apertures to affix to the door frame, the mounting plate having a midsection positioned between the first base plate end and the second base plate end, the midsection having a locking aperture positioned crosswise therethrough to receive first pin end, the first pin end pass therethrough the locking aperture until the magnet contacts the mounting plate, and the first pin end extends across to the door, positioning mounting plate against the door frame, and utilizing two or more base screws configured to extend therethrough the one or more base attachment apertures to removeably attach the first base plate end and the second base plate end of the mounting plate thereto the door frame.

A feature of the door lock assembly for a door hinged to a door frame and methods of use thereof may include mounting door lock assembly on the inside of an inwardly swinging door to prevent the opening of the door from the outside to provide added security for the inhabitants of a dwelling.

A feature of the door lock assembly for a door hinged to a door frame and methods of use thereof is to provide a door lock assembly that is easily installed by the occupant when extra door lock protection is required.

A feature of the door lock assembly for a door hinged to a door frame and methods of use thereof is to provide a door lock assembly that is extremely difficult to forcibly break away from the door and door frame and maintains holding power against a large force.

A feature of the door lock assembly for a door hinged to a door frame and methods of use thereof is to provide a door lock assembly that will not present an unsightly appearance when not in use.

A feature of the door lock assembly for a door hinged to a door frame and methods of use thereof is to provide a door lock assembly that is simple enough to operate by a school age child.

A feature of the door lock assembly for a door hinged to a door frame and methods of use thereof is to provide a door lock assembly that is of a relatively simple and inexpensive to manufacture and of durable and reliable construction.

A feature of the door lock assembly for a door hinged to a door frame and methods of use thereof is to provide a door lock assembly that which can be installed with a minimum of labor and expense.

A feature of the door lock assembly for a door hinged to a door frame and methods of use thereof is to provide a door lock assembly that provides a quick and simple way to secure the door.

A feature of the door lock assembly for a door hinged to a door frame and methods of use thereof is to provide a door lock assembly that provides strength that will withstand more force than current locks on the market.

A feature of the door lock assembly for a door hinged to a door frame and methods of use thereof is to provide door hinge supports to reinforce the hinge side of the door.

A feature of the door lock assembly for a door hinged to a door frame and methods of use thereof is to enable a teacher to securely lock a classroom door from inside the classroom until the teacher unlocks the same to permit opening of the classroom.

A feature of the door lock assembly for a door hinged to a door frame and methods of use thereof is to provide a lock assembly used to retrofit preexisting door frames, door jambs, to include a means for securing the door against opening.

A feature of the door lock assembly for a door hinged to a door frame and methods of use thereof is to provide a lock assembly that can be used on the interior or exterior of a door and on interior or exterior doors.

A feature of the door lock assembly for a door hinged to a door frame and methods of use thereof is to provide a lock assembly that can be preferably used to prevent the door opening inwardly from a closed position.

A feature of the door lock assembly for a door hinged to a door frame and methods of use thereof is to provide a strengthened lock to prevent being kicked or rammed in by a large force.

A feature of the door lock assembly for a door hinged to a door frame and methods of use thereof is to enable the pin to affix to the door frame, and extend across the door frame gap to the front face or strike plate of the interior or inside surface of the door.

A feature of the door lock assembly for a door hinged to a door frame and methods of use thereof is to provide secured mount positioned against or affixed to the interior door frame and/or wall to provide a strong support for the pin.

A feature of the door lock assembly for a door hinged to a door frame and methods of use thereof is to provide a pin keeper so as to keep the pin in close proximity to the mount.

A feature of the door lock assembly for a door hinged to a door frame and methods of use thereof is to provide a lock assembly that can quickly lockdown classroom doors in an emergency situation and alert other teachers to do the same.

A feature of the door lock assembly for a door hinged to a door frame and methods of use thereof is its ability to enable quick deployment of the lock even by a child.

A feature of the door lock assembly for a door hinged to a door frame and methods of use thereof is its ability to provide tamper-resistance whereby the alarm will sounds if the pin is removed provided a deterrent to unauthorized users.

These and other features of the door lock assembly for a door hinged to a door frame and methods of use thereof will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present door lock assembly for a door hinged to a door frame and methods of use thereof will be better understood by reading the Detailed Description of the Preferred and Selected Alternate Embodiments with reference to the accompanying drawing Figures, in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1, 2, 3A, 3B, 4A, 4B, 5, and 6 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figures 1, 2, 3A, 3B:
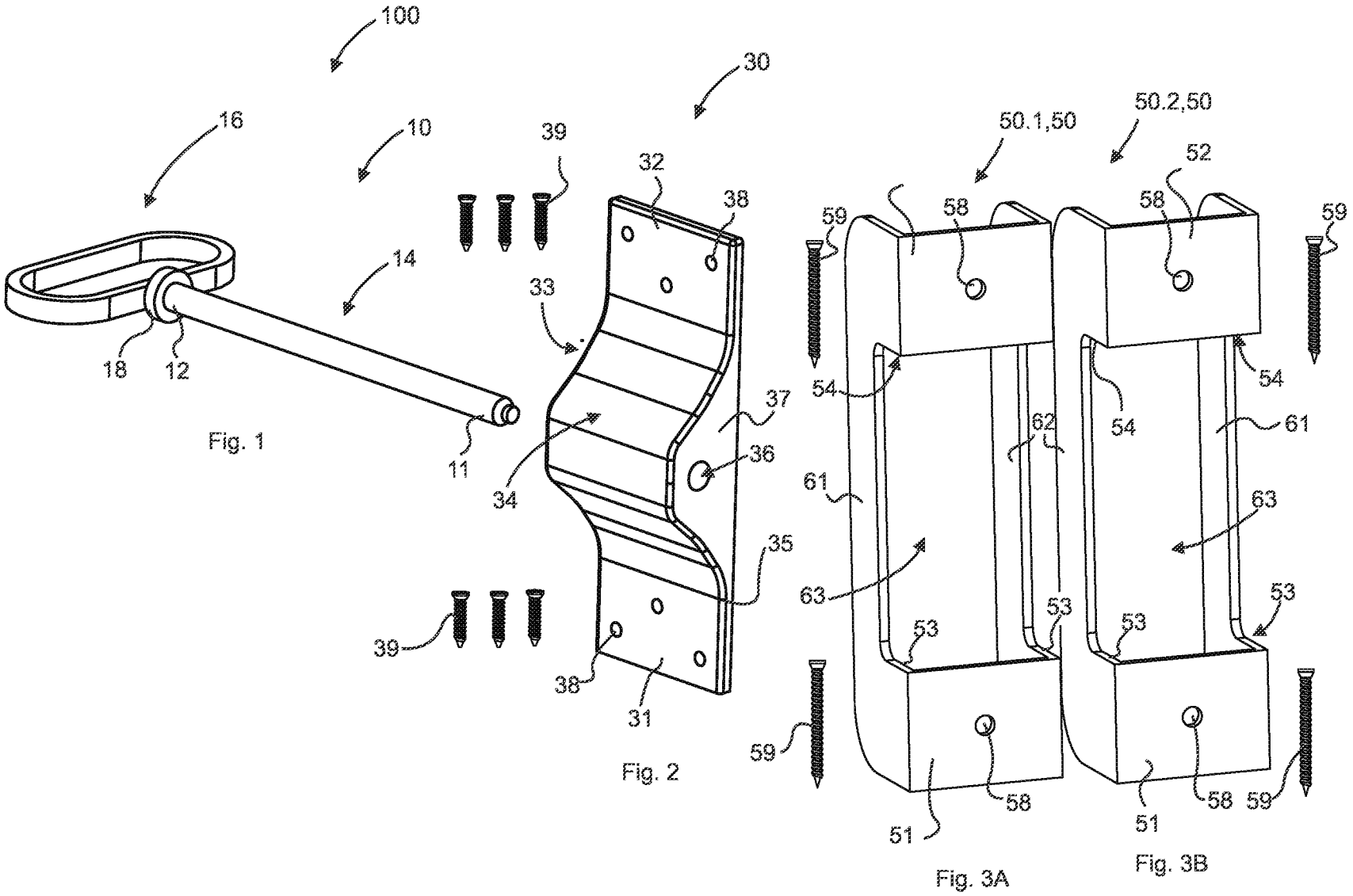
FIG. 1 is a perspective view of the handled pin of the door lock assembly according to select embodiments of the instant disclosure.
FIG. 2 is a perspective view of the mounting plate of the door lock assembly, according to select embodiments of the instant disclosure.
FIG. 3A is a perspective view of a first hinge support bracket of the door lock assembly, according to select embodiments of the instant disclosure.
FIG. 3B is a perspective view of a second hinge support bracket of the door lock assembly, according to select embodiments of the instant disclosure.

Referring now to FIG. 1, by way of example, and not limitation, there is illustrated an example embodiment of handled pin 10 of preferably multipart lock assembly, such as door lock assembly 100 configured as a door lock assembly for a door D hinged to a door frame DF. Preferably handled pin 10 may include a linear rod, bolt, or conduit, such as pin 14 having a first pin end 11 and second pin end 12. Preferably second pin end 12 may be formed with a gripping mechanism, such as handle 16 attached thereto second pin end 12 and configured to enable gripping of handled pin 10 by a user. It is contemplated herein in a preferred embodiment that handle 16 may be configured as continuous oval loop; however other shapes are contemplated herein. Moreover, handled pin 10 may include magnet 18 positioned proximate second pin end 12 and proximate a junction between handle 16 and second pin end 12. It is contemplated herein in a preferred embodiment that magnet 18 may be configured with magnet hole or aperture to fit pin 14 there through and more specifically may be shaped as a washer and be positioned therearound second pin end 12. Magnet 18 may preferably be utilized as a stop when inserting pin 10 into a hole or aperture and more specifically to attract or be attracted thereto an iron or metal material to removably hold magnet 18 and handled pin 10 in position.

Figure 5:
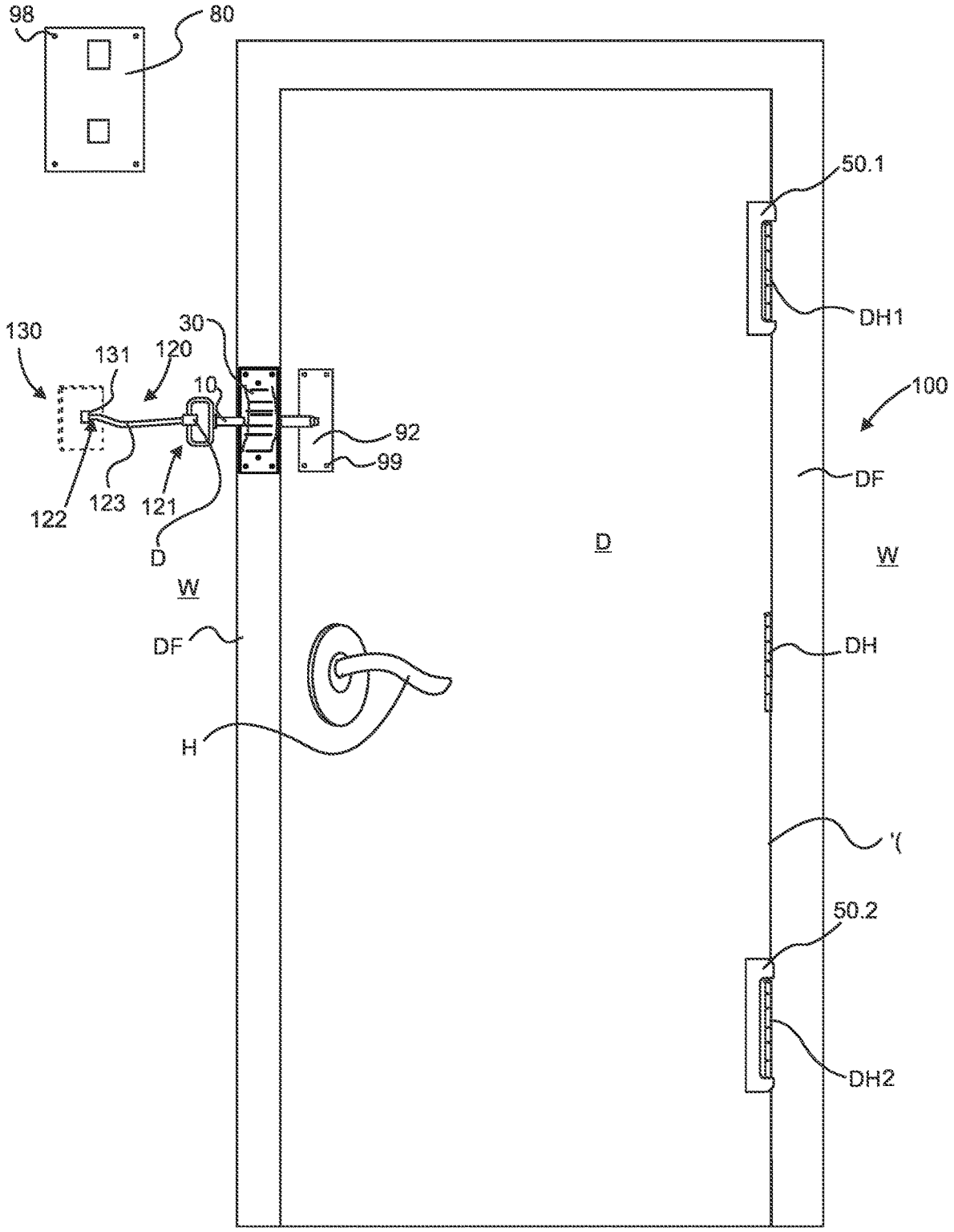
FIG. 5 is a front view of the door lock assembly in use with door and door frame, according to select embodiments of the instant disclosure.

Referring now to FIG. 2, by way of example, and not limitation, there is illustrated an example embodiment of mounting plate 30 of door lock assembly 100 configured as a door lock assembly for a door D hinged to a door frame DF. Preferably mounting plate 30 may include planar base plate 35 having a flat section, such as first base plate end 31 and a second base plate end 32. Preferably first base plate end 31 and a second base plate end 32 may include one or more holes or openings, such as base attachment apertures 38 formed therein first base plate end 31 and a second base plate end 32. Preferably base attachment apertures 38 may include two or more attachment devices, such as base screws 39 configured to extend there through base attachment apertures 38 and attach or removeably affix planar base plate 35 thereto door frame DF as shown in FIG. 5. It is contemplated herein a preferred embodiment that a plurality of complementary-shaped holes aligned with base attachment apertures 38 may be drilled in door frame DF and extend inwardly therein door frame DF to receive base screws 39 to attach or removeably affix planar base plate 35 thereto door frame DF, whereby base screws 39 can extend through these attachment apertures 38 in order to fasten first base plate end 31 and a second base plate end 32 to door frame DF.

It is further contemplated herein that base screws 39 may include other attachment devices or processes to attach or removeably affix planar base plate 35 thereto door frame DF, such as nails, bolts and nuts, adhesive, welding, and the like.

Moreover, mounting plate 30 may include a base, middle body, or structure, such as midsection 34 formed integral to planar base plate 35 and positioned between first base plate end 31 and a second base plate end 32. Preferably midsection 34 may include a crosswise hole or opening, such as locking aperture 36 that extends through midsection 34. Locking aperture 36 may extend there through midsection 34 crosswise or approximately perpendicular to first base plate end 31 and a second base plate end 32 from first body side 37 to second body side 33. It is contemplated herein a preferred embodiment that midsection 34 may be configured as mound or hump or block shaped or other shape capable of providing strength and holding power to locking aperture 36. It is further contemplated herein a preferred embodiment that locking aperture 36 may be configured to receive first pin end 11 of pin 14 therein second body side 33 of locking aperture 36 and pass there through locking aperture 36 to and out of first body side 37 of locking aperture 36 or vice-a-versa until of magnet 18 of pin 14 contacts second body side 33. Moreover, for an outswing door D mounting plate 30 is preferably mounted to door D and pin 14 extends there through mounting plate 30 across door frame DF to prevent door D from swinging or being pulled outward. It is still further contemplated herein a preferred embodiment that magnet 18 may attract thereto second body side 33 and hold pin 14 therein locking aperture 36 of midsection 34.

Referring now to FIGS. 3A and 3B, by way of example, and not limitation, there is illustrated an example embodiment of two or more plates or channel, such as hinge reinforcement brackets 50 configured to releasably affix therearound door hinge DH to reinforce the door hinge DH. Preferably hinge reinforcement brackets 50 may include first hinge reinforcement brackets 50.1 and second hinge reinforcement brackets 50.2. Preferably each hinge reinforcement brackets 50 may be configured as a three sided channel having a front or top side, such as first channel side 51, and two side channel, such as second channel side 61 and third channel side 62 whereby second channel side 61 and third channel side 62 may extend therefrom first channel side 51 at approximately ninety degrees or perpendicular. Preferably first channel side 51 may include one or more holes or openings, such as hinge attachment aperture 58 configured to extend there through first channel side 51.

Preferably hinge reinforcement brackets 50 may include two or more attachment devices, such as hinge screws 59 configured to extend there through hinge attachment aperture 58 and attach or removeably affix hinge reinforcement brackets 50 thereto door D. It is contemplated herein a preferred embodiment that a plurality of complementary-shaped holes aligned with hinge attachment aperture 58 may be drilled in door D and extend inwardly therein door D to receive hinge screws 59 to attach or removeably affix hinge reinforcement brackets 50 thereto door D. It is further contemplated herein that hinge screws 59 may include other attachment devices or processes to attach or removeably affix hinge reinforcement brackets 50 thereto door D, such as nails, bolts and nuts, adhesive, welding, and the like.

Moreover, hinge reinforcement brackets 50 may include a notched out or cutout, such as slot 63 formed in one or all of first channel side 51, second channel side 61, and/or third channel side 62 where second channel side 61, and/or third channel side 62 may include slot edges, such as first slot edge 53 and second slot edge 54. Preferably slot 63 may be configured to enable door hinge DH to pass therethrough slot 63 and enable first channel side 51 to lay flat or contact door end DE so as to allow door hinge DH to close completely. It is contemplated herein a preferred embodiment that slot 63 may be configured to enable hinge reinforcement brackets 50 to fit therearound or surround door hinge DH to reinforce door D proximate door hinge DH against an external force.

It is recognized herein that handled pin 10 and mounting plate 30 of door lock assembly 100, and hinge reinforcement brackets 50 may be constructed of metal, steel, alloy or plastic or more specifically high density polyethylene or similar high tensile or strengthened materials, as these material offers a variety of forms and shapes and provide strength; however, other suitable materials or the like, can be utilized, provided such material has sufficient strength and/or durability as would meet the purpose described herein.

Figure 4A:
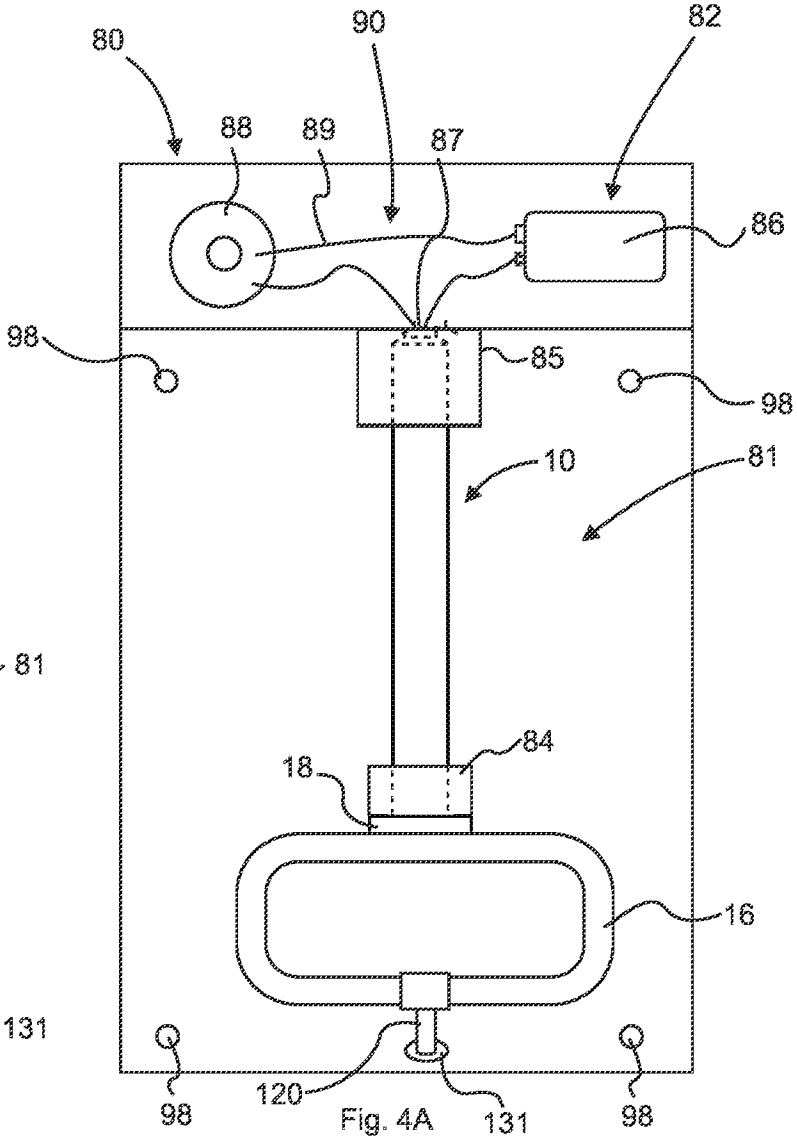
FIG. 4A is a front view of the pin keeper of the door lock assembly, according to select embodiments of the instant disclosure.
Figure 4B:
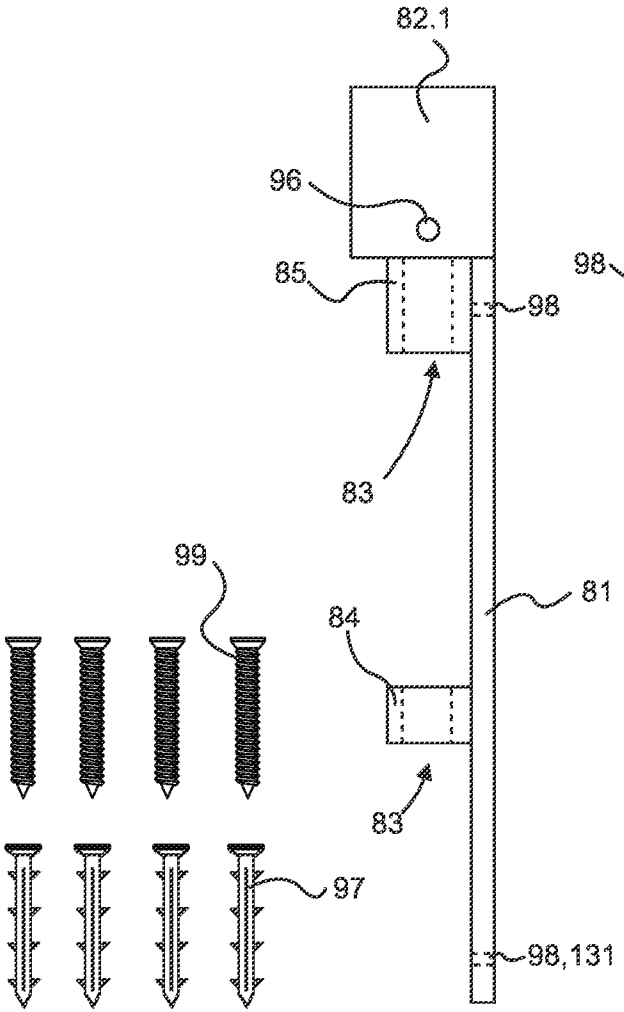
FIG. 4B is a side view of the pin keeper of the door lock assembly, according to select embodiments of the instant disclosure.

Referring now to FIGS. 4A and 4B, by way of example, and not limitation, there is illustrated an example embodiment of pin keeper 80 configured to releasably secure therein handled pin 10 proximate mounting plate 30. Preferably pin keeper 80 may be configured with first section, such as back plate 81 and second section, alarm section 82. Preferably back plate 81 may include one or more holes or openings, such as back plate attachment apertures 98 configured to extend therethrough back plate 81. Preferably back plate 81 may include two or more attachment devices, such as back plate screws 99 configured to extend there through back plate attachment apertures 98 and attach or removeably affix back plate 81 thereto wall W or wall anchor 97 proximate mounting plate 30. It is contemplated herein a preferred embodiment that a plurality of complementary-shaped holes aligned with back plate attachment apertures 98 may be drilled in wall W and extend inwardly therein wall W to receive back plate attachment apertures 98 and back plate screws 99 to attach or removeably affix back plate 81 thereto wall W.

Moreover, back plate 81 may include one or more brackets, such as first pin support 84 and second pin support 85 positioned in line and spaced apart from each other. Preferably first pin support 84 and second pin support 85 may include hole or opening, such as keeper aperture 83 that extends through first pin support 84 and second pin support 85. Preferably keeper aperture 83 may be sized to accommodate and hold, secure, or removeably affix first pin end 11 and second pin end 12 of pin 14 therein second pin support 85 and first pin support 84. It is contemplated herein a preferred embodiment that magnet 18 may attract thereto first pin bracket 84 and hold pin 14 therein first pin support 84 and second pin support 85.

Furthermore, pin keeper 80 may include status change alert system, such as alarm system 90. Preferably alarm system 90 may include power supply 86 in electrical communication via wires 89 thereto both switch 87 and an alert mechanism whether audio or visual, such as speaker 88. Preferably switch 87 is positioned proximate either of first pin support 84 and/or second pin support 85 and remains in an open switch position or status (not sounding alarm system 90) when first pin end 11 and/or second pin end 12 of pin 14 is preferably positioned therein second pin support 85 and/or first pin support 84. When pin 14 is removed, first pin end 11 and/or second pin end 12 from second pin support 85 and/or first pin support 84, switch 87 returns to normally closed switch position sounding alarm system 90. It is contemplated herein a preferred embodiment that alarm section 82 may include cover 82.1 to protect alarm system 90 and include set screw 96 to attach or removeably affix cover 82.1 thereto alarm section 82 or back plate 81. It is contemplated herein that cover 82.1 may be a side cover or top cover.

Referring now to FIG. 5, by way of example, and not limitation, there is illustrated an example embodiment of door lock assembly 100 installed on door D hinged via hinge H to a door frame DF therein wall W. Preferably first hinge reinforcement brackets 50.1 and second hinge reinforcement brackets 50.2 may be installed over first door hinge DH1 and second door hinge DH2, respectively to reinforce the door hinge DH. Moreover, pin keeper 80 may be installed thereon wall W proximate mounting plate 30. Furthermore, mounting plate 30 may be installed thereto door frame DF, preferably above handle H. It is contemplated herein that mounting plate 30 may be positioned anywhere on door frame DF opposite, above or below hinge H side of door D for an in-swinging (inwardly swinging) door D. Alternatively, mounting plate 30 may be positioned anywhere on door D opposite, above or below hinge H side of door D for an out-swinging (outwardly swinging) door D. Still furthermore handled pin 10 may be removed from pin keeper 80 sounding alarm system 90 and handled pin 10 may be inserted therein locking aperture 36 of midsection 34 of mounting plate 30, whereby door lock assembly 100 may be utilized on an inwardly swinging door D to prevent the opening of door D from the outside to provide added security for the inhabitants therein and holding door D securely closed. Still furthermore in the alternative handled pin 10 may be removed from pin keeper 80 sounding alarm system 90 and handled pin 10 may be inserted therein locking aperture 36 of midsection 34 of mounting plate 30, whereby door lock assembly 100 may be utilized on an outwardly swinging door D to prevent the opening of door D from the inside to provide added security for the inhabitants therein and holding door D securely closed.

It is contemplated herein that door D may include a door stop, such as strike plate 92 affixed thereto door D proximate where first pin end 11 of pin 14 contacts door D for an inwardly swinging door D to distribute the load, of pin 14 to maintain door D closed, across a larger surface area of door D.

It is further contemplated in the alternative herein that door frame DF may include a door stop, such as strike plate 92 affixed thereto door frame DF proximate where first pin end 11 of pin 14 contacts door frame DF for an outwardly swinging door D to distribute the load, of pin 14 to maintain door D closed, across a larger surface area of door frame DF.

It is further contemplated herein that door D may include a door stop, such as strike plate 92 having locking aperture 36 affixed thereto door D proximate where first pin end 11 of pin 14 contacts door D for an inwardly swinging or outwardly swinging door D to maintain door D closed.

It is further contemplated herein that strike plate 92 may be an additional mounting plate 30 and handled pin 10 may be positioned through two locking aperture 36 for an additionally secure door D to prevent inwardly swinging or outwardly swinging door D and maintain door D closed.

It is still further contemplated herein that door lock assembly 100 may include keyed pin retraction system 120. Keyed pin retraction system 120 may include towing or tugging device, such as cable 123 having first cable end 121 terminating thereon second pin end 12 or handle 16 of pin 14 and second cable end 122 may pass therethrough hole or opening, such as pin retraction aperture 131 formed therethrough wall W proximate pin keeper 80 or mounting plate 30. Preferably second cable end 122 may be accessible from the other side or outside wall W to enable an authorized operator to retract pin 14 therefrom locking aperture 36 via keyed pin retraction system 120 once all potential threats have terminated. Moreover, second cable end 122 may be housed, concealed, or locked therein key access latch device, such as lock box 130 and accessible via authorized key or combination thereto lock box 130.

Figure 6:
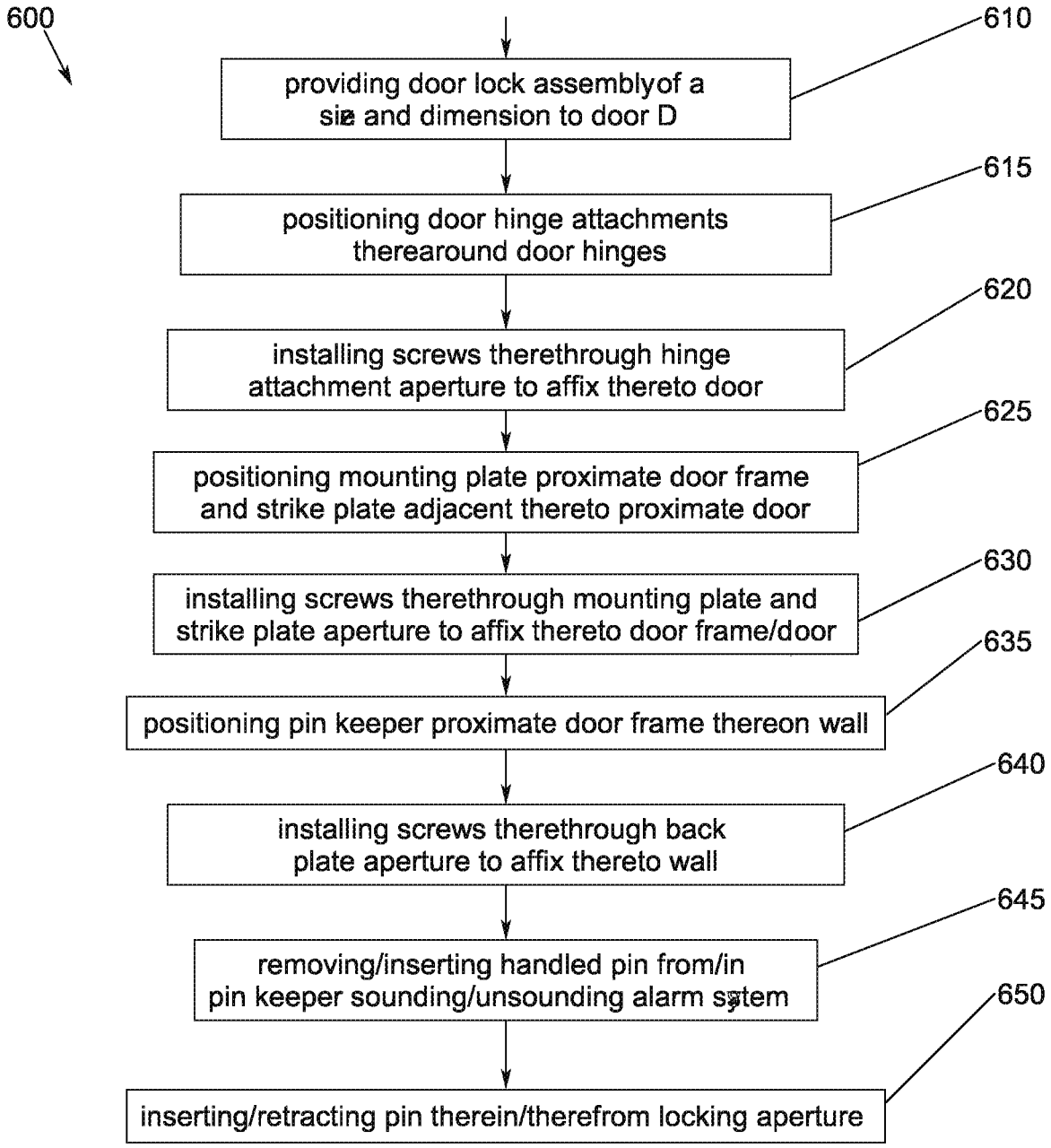
FIG. 6 is a flow diagram of a method of installation and use of hinged lid assembly affixed to a flanged riser according to select embodiments of the instant disclosure.

Referring now to FIG. 6, there is illustrated a flow diagram 600 of a method for installation of door lock assembly 100 thereto door D and door frame DF positioned within wall W. In block or step 610, providing door lock assembly 100 as set forth in any of the embodiments discussed herein, and/or shown in FIGS. 1-5. In block or step 615 positioning first hinge reinforcement brackets 50.1 and second hinge reinforcement brackets 50.2 therearound first door hinge DH1 and second door hinge DH2. In block or step 620 installing hinge screws 59 there through hinge attachment aperture 58 to attach or removeably affix hinge reinforcement brackets 50 thereto door D. This prevents door D from failing if an intruder is trying to kick door D open on the hinge side of door D.

In block or step 625 positioning mounting plate 30 proximate door frame DF, preferably above handle H and strike plate 92 adjacent mounting plate 30 proximate door D. In block or step 630 installing base screws 39 there through base attachment apertures 38 to removeably affix mounting plate 30 thereto door frame DF. In block or step 635 positioning pin keeper 80 thereon wall W proximate mounting plate 30. In block or step 640 installing back plate screws 99 there through back plate attachment apertures 98 to removeably affix back plate 81 thereto wall W.

In case of an emergency, in block or step 645 removing handled pin 10 by sliding it down or out of first pin bracket 84 and second pin bracket 85 of pin keeper 80 whereby switch 87 returns to normally closed position sounding alarm system 90. The alarm will prevent unauthorized users from removing the pin unnecessarily and will also alert people in the event of an emergency to proceed to locking their doors as well. In block or step 650 inserting or sliding first pin end 11 of pin 14 therein second body side 33 of locking aperture 36 and passing therethrough locking aperture 36 to extend out of first body side 37 of locking aperture 36 until magnet 18 of pin 14 contacts second body side 33 whereby to prevent door D from opening, or retracting pin 14 therefrom locking aperture 36 via keyed pin retraction system 120 by an authorized operator.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

It is understood herein that various changes in the material used, shape, size (diameters of riser 10), arrangement of parts, and parts are connected with bolts, pins, screws or similar fasteners without departing from the spirit of the scope of the claims herein.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein but is limited only by the following claims.

The invention claimed is:

1. A door lock assembly to secure a door having hinges between the door and a door frame positioned in a wall, said door lock assembly comprising:

a pin having a first pin end and a second pin end, said second pin end formed with a handle attached thereto and a magnet positioned proximate a junction between said handle and said second pin end;

a mounting plate having a first base plate end and a second base plate end, said first base plate end and said second base plate end having one or more base attachment apertures to affix to the door frame, said mounting plate having a midsection positioned between said first base plate end and said second base plate end, said midsection having a locking aperture positioned crosswise therethrough to receive said first pin end, said first pin end passes therethrough said locking aperture until said magnet contacts said mounting plate, and said first pin end extends across the door;

a pin keeper having a back plate and one or more pin supports mounted on said back plate, said one or more pin supports configured to receive said pin; and one or more back plate attachment apertures.

2. The door lock assembly of claim 1, wherein said magnet is positioned therearound said second pin end.

3. The door lock assembly of claim 1, wherein said handle is configured as continuous oval loop.

4. The door lock assembly of claim 2, wherein said magnet is utilized as a stop when said pin is inserted into said locking aperture of said mounting plate.

5. The door lock assembly of claim 1, wherein said magnet is attracted thereto said mounting plate to hold said pin in contact with said mounting plate.

6. The door lock assembly of claim 1, further comprising two or more base screws configured to extend therethrough said one or more base attachment apertures to removeably attach said first base plate end and said second base plate end of said mounting plate thereto the door frame.

7. The door lock assembly of claim 1, further comprising one or more hinge reinforcement brackets formed as a channel having a slot therein to receive one of the hinges and affix thereto the door.

8. The door lock assembly of claim 7, further comprising one or more hinge attachment apertures.

9. The door lock assembly of claim 8, further comprising one or more hinge screws configured to extend therethrough said one or more hinge attachment apertures to removeably attach said one or more hinge reinforcement brackets thereto the door.

10. The door lock assembly of claim 1, further comprising one or more back plate screws configured to extend therethrough said one or more back plate attachment apertures to removeably attach said back plate thereto the wall proximate said mounting plate.

11. The door lock assembly of claim 1, wherein said one or more pin supports having a first pin support and a second pin support configured in line and spaced apart from each other.

12. The door lock assembly of claim 11, wherein said magnet is utilized as a stop when said pin is inserted into said first pin support of said pin keeper.

13. The door lock assembly of claim 12, wherein said magnet is attracted thereto said first pin support to hold said pin therein said pin keeper.

14. The door lock assembly of claim 1, said back plate further comprising an alarm system having a power supply in electrical communication with a switch and an alert mechanism.

15. The door lock assembly of claim 11, wherein said switch is positioned proximate said second pin support and said switch is in an open switch position when said pin is inserted therein said second pin support.

16. The door lock assembly of claim 15, wherein said switch is in a closed switch position when said pin is removed therefrom said second pin support sounding said alarm system.

17. A method of securing a door having hinges between the door and a door frame positioned in a wall, said method comprising the steps of:

providing a door lock assembly with a pin having a first pin end and a second pin end, said second pin end formed with a handle attached thereto and a magnet positioned proximate a junction between said handle and said second pin end, a mounting plate having a first base plate end and a second base plate end, said first base plate end and said second base plate end having one or more base attachment apertures to affix to the door frame, said mounting plate having a midsection positioned between said first base plate end and said second base plate end, said midsection having a locking aperture positioned crosswise therethrough to receive said first pin end, said first pin end pass therethrough said locking aperture until said magnet contacts said mounting plate, and said first pin end extends across the door, a pin keeper having one or more back plate attachment apertures, said pin having a back plate and one or more pin supports mounted on said back plate;

positioning said mounting plate against the door frame; and utilizing two or more base screws configured to extend therethrough said one or more base attachment apertures to removeably attach said first base plate end and said second base plate end of said mounting plate thereto the door frame.

18. The method of claim 17, further comprising the step of inserting said pin therein said locking aperture of said mounting plate to prevent opening of the door.

19. The method of claim 17, further comprising the step of positioning said pin keeper against the wall proximate said mounting plate.

20. The method of claim 19, further comprising the step of utilizing two or more back plate screws configured to extend therethrough said one or more back plate attachment apertures to removeably attach said pin keeper thereto the wall.

21. The method of claim 17, further comprising the step of inserting said pin therein said one or more pin supports to hold said pin.

22. The method of claim 17, further comprising the step of providing a hinge reinforcement bracket having one or more hinge attachment apertures.

23. The method of claim 22, further comprising the step of positioning said hinge attachment aperture positioned therearound the hinge of the door.

24. The method of claim 23, further comprising the step of utilizing two or more hinge screws configured to extend therethrough said one or more hinge attachment aperture to removeably attach said hinge reinforcement bracket thereto the door.

25. The method of claim 21, further comprising the step of retracting said pin therefrom said one or more pin supports via keyed pin retraction system.

* * * * *